US011318696B2

(12) United States Patent
Roth

(10) Patent No.: US 11,318,696 B2
(45) Date of Patent: May 3, 2022

(54) PORTABLE POWER-DRIVEN PRESS

(71) Applicant: Calvin Fabrications Co., Newville, PA (US)

(72) Inventor: Calvin Roth, Newville, PA (US)

(73) Assignee: CALVIN FABRICATIONS CO., Newville, PA (US)

( * ) Notice: Subject to any disclaimer, the term of this patent is extended or adjusted under 35 U.S.C. 154(b) by 0 days.

(21) Appl. No.: 17/172,716

(22) Filed: Feb. 10, 2021

(65) Prior Publication Data

US 2021/0299988 A1 Sep. 30, 2021

(51) Int. Cl.

| | |
|---|---|
| ***B30B 15/04*** | (2006.01) |
| ***B30B 1/18*** | (2006.01) |
| ***B25B 5/02*** | (2006.01) |
| ***B30B 1/00*** | (2006.01) |
| ***B25B 5/08*** | (2006.01) |

(52) U.S. Cl.

CPC ..... *B30B 15/04* (2013.01); *B25B 5/02* (2013.01); *B25B 5/087* (2013.01); *B30B 1/007* (2013.01); *B30B 1/18* (2013.01)

(58) Field of Classification Search

CPC . B30B 15/04; B30B 15/0029; B30B 15/0035; B30B 15/045; B30B 1/007; B30B 1/18; B30B 7/04; B30B 5/02; B30B 5/087; B30B 5/166

USPC ..... 269/33

See application file for complete search history.

(56) References Cited

U.S. PATENT DOCUMENTS

| | | | | |
|---|---|---|---|---|
| 3,190,214 | A * | 6/1965 | Adams | B30B 15/0029 100/214 |
| 5,829,347 | A * | 11/1998 | Hiruma | B30B 15/26 100/43 |
| 5,937,694 | A * | 8/1999 | Mueller | B21J 15/18 72/452.1 |
| 7,108,459 | B1 * | 9/2006 | Mueller | B23B 39/00 408/1 R |
| 10,583,066 | B1 * | 3/2020 | Abroms | A61H 3/04 |
| 2005/0184439 | A1 * | 8/2005 | Janson | B25B 5/006 269/6 |
| 2007/0251342 | A1 * | 11/2007 | Murao | F16H 25/229 74/59 |
| 2017/0355010 | A1 * | 12/2017 | Janiszewski | B30B 1/326 |
| 2020/0147914 | A1 * | 5/2020 | Meyer | B30B 1/18 |

FOREIGN PATENT DOCUMENTS

| | | | | |
|---|---|---|---|---|
| JP | 03057600 | A * | 3/1991 | B30B 15/045 |

* cited by examiner

*Primary Examiner* — Joseph J Hail
*Assistant Examiner* — J Stephen Taylor
(74) *Attorney, Agent, or Firm* — McNees Wallace & Nurick LLC

(57) ABSTRACT

A portable press configured to selectably apply either compression or expansion forces to objects or workpieces, thereby permitting multiple functions such as pressing, bending, fixturing, spreading, lifting, and position holding assistance in fabrication applications to the objects or workpieces.

10 Claims, 8 Drawing Sheets

PORTABLE POWER-DRIVEN PRESS

FIELD OF THE INVENTION

The present invention is directed to reversible portable presses capable of selectably applying compressive forces and expansion forces during different operating modes.

BACKGROUND OF THE INVENTION

Current tools or devices that perform pressing, bending, fixturing, spreading, lifting, or position holding assistance in fabrication often require a large workpiece to be disassembled into a smaller workpiece assembly to have the operation performed. Then a reassembly process must occur. This typically requires multiple specially configured tools or devices to accommodate the disassembly/reassembly processes, which is costly and requires significant storage space in a manufacturing facility.

There is a need for a single lightweight mobile device, which can be taken to a workpiece that permits the required operations to be performed in place and reduce disassembly and assembly.

SUMMARY OF THE INVENTION

In one embodiment, a portable press including a base affixed to an end of a first elongate member having a longitudinal axis, the base having a base portion. The press further includes a sleeve slidably received by the first elongate member, the sleeve securable to the first elongate member by at least one fastener. The press further includes a tab affixed to and extending away from the sleeve, the tab securing a drive device having a tip drivingly movable away from the drive device along a second axis parallel to the longitudinal axis, the second axis extending through the base portion. In response to the at least one fastener securing the drive device in a first operating arrangement relative to the base, the drive device drivingly moves the tip toward the base for applying a compression force along the second axis to corresponding portions of one or more objects positioned between and in contact with the tip and the base portion. In response to the at least one fastener securing the drive device in a second operating arrangement opposite the first arrangement relative to the base, the drive device drivingly moves the tip away from the base for applying an expansion force along the second axis to corresponding portions of one or more objects positioned between and in contact with the tip and the base portion.

In another embodiment, a portable press includes a base affixed to an end of a first elongate member having a longitudinal axis, the base having a base portion. The press further includes a sleeve slidably received by the first elongate member, the sleeve securable to the first elongate member by at least one fastener. The press further includes a tab affixed to and extending away from the sleeve, the tab securing a drive device having a tip drivingly movable away from the drive device along a second axis parallel to the longitudinal axis, the second axis extending through the base portion. In response to the at least one fastener securing the drive device in a first operating arrangement relative to the base, the drive device drivingly moves the tip toward the base for applying a compression force along the second axis to corresponding portions of one or more objects positioned between and in contact with the tip and the base portion. In response to the at least one fastener securing the drive device in a second operating arrangement opposite the first arrangement relative to the base, the drive device drivingly moves the tip away from the base for applying an expansion force along the second axis to corresponding portions of one or more objects positioned between and in contact with the tip and the base portion. The base portion includes a second tip extends to a third tip, the second tip extending through and away from a first surface of the base along the second axis, the third tip extending through and away from a second surface opposite the first surface.

In a further embodiment, a method of operating a portable press, includes providing a base affixed to an end of a first elongate member having a longitudinal axis, the base having a base portion; a sleeve slidably received by the first elongate member, the sleeve securable to the first elongate member by at least one fastener; a tab affixed to and extending away from the sleeve, the tab securing a drive device having a tip drivingly movable away from the drive device along a second axis parallel to the longitudinal axis, the second axis extending through the base portion, the portable press capable of operating in a first operating arrangement and a second operating arrangement opposite the first arrangement relative to the base. The method further includes installing the at least one fastener to secure the sleeve to the first elongate member with the drive device in the first operating arrangement relative to the base, and drivingly moving the tip toward the base for applying a compression force along the second axis to corresponding portions of one or more objects positioned between and in contact with the tip and the base portion. The method further includes removing the at least one fastener, and slidably disengaging the sleeve from the first elongate member. The method further includes reversing ends of the sleeve facing the first elongate member. The method further includes slidably reengaging the sleeve and the first elongate member with the drive device in the second operating arrangement, and drivingly moving the tip away from the base for applying an expansion force along the second axis to corresponding portions of one or more objects positioned between and in contact with the tip and the base portion.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

The press of the present invention is a multi-function tool capable of performing functions previously requiring multiple other tools and devices, while also being mobile or portable and sufficiently light weight to move to a site of a workpiece, the workpiece being either large or small. The present press can be used for multiple functions such as pressing, bending, fixturing, spreading, lifting, and position holding assistance in fabrication applications. This press can be adjusted to fit pressing or spreading requirements with a plurality of positions, such as four, accommodating various size requirements requiring the application of either inward (compressive) or outward (expansion) force to workpieces or objects. The positions are adjustable by removing the one or more fasteners securing the drive device at a predetermined spacing and operating arrangement relative to the base of the press, and then slidably moving different corresponding portions of the press relative to one another until the desired position or spacing and operating arrangement relative to the base is achieved, and then inserting the one or more fasteners to fix the position.

Figure 1:
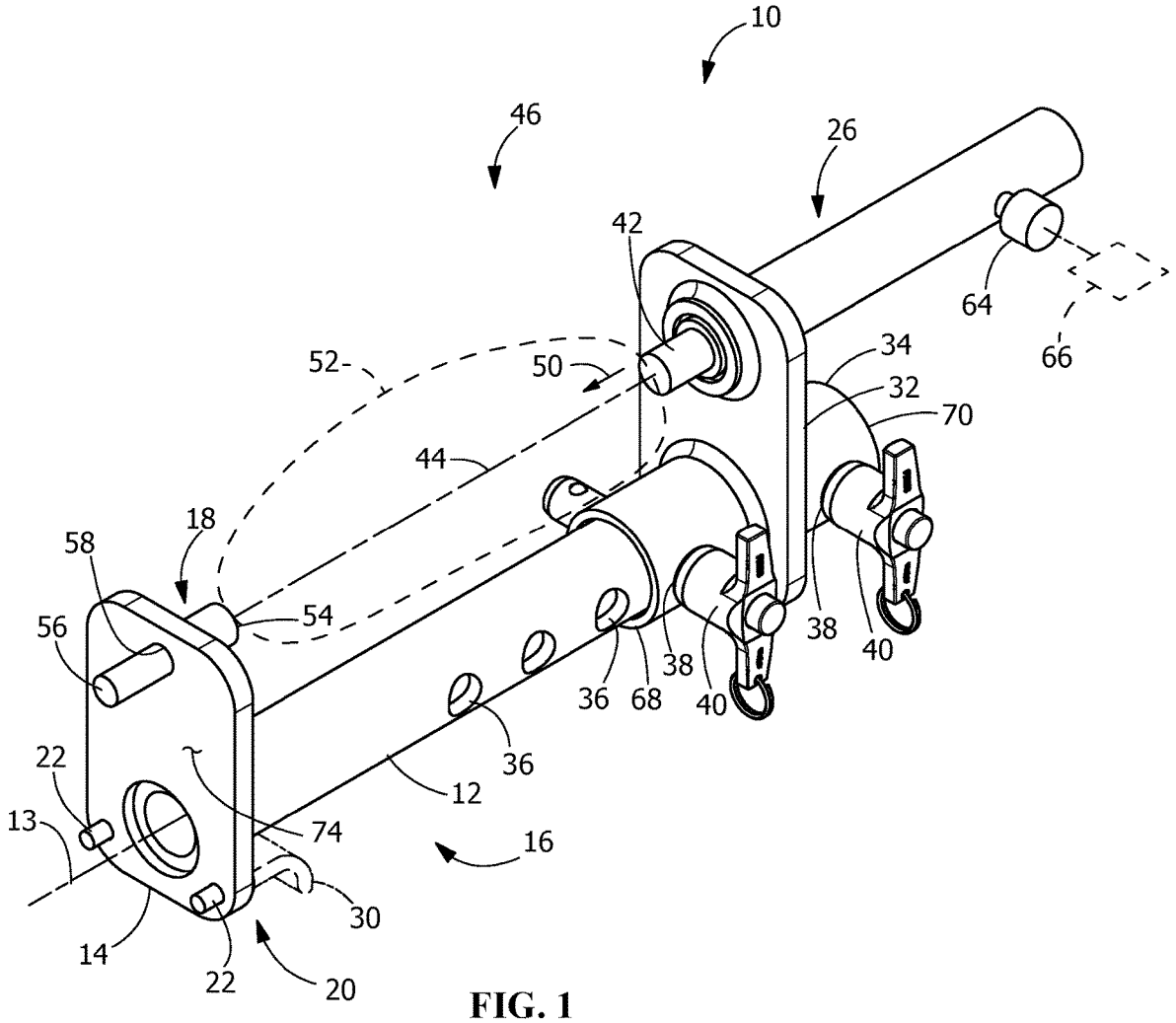
FIG. 1 is a left side bottom perspective view lying down of an exemplary press with a drive device in an exemplary operating arrangement for applying a compressive force to an object.
Figure 2:
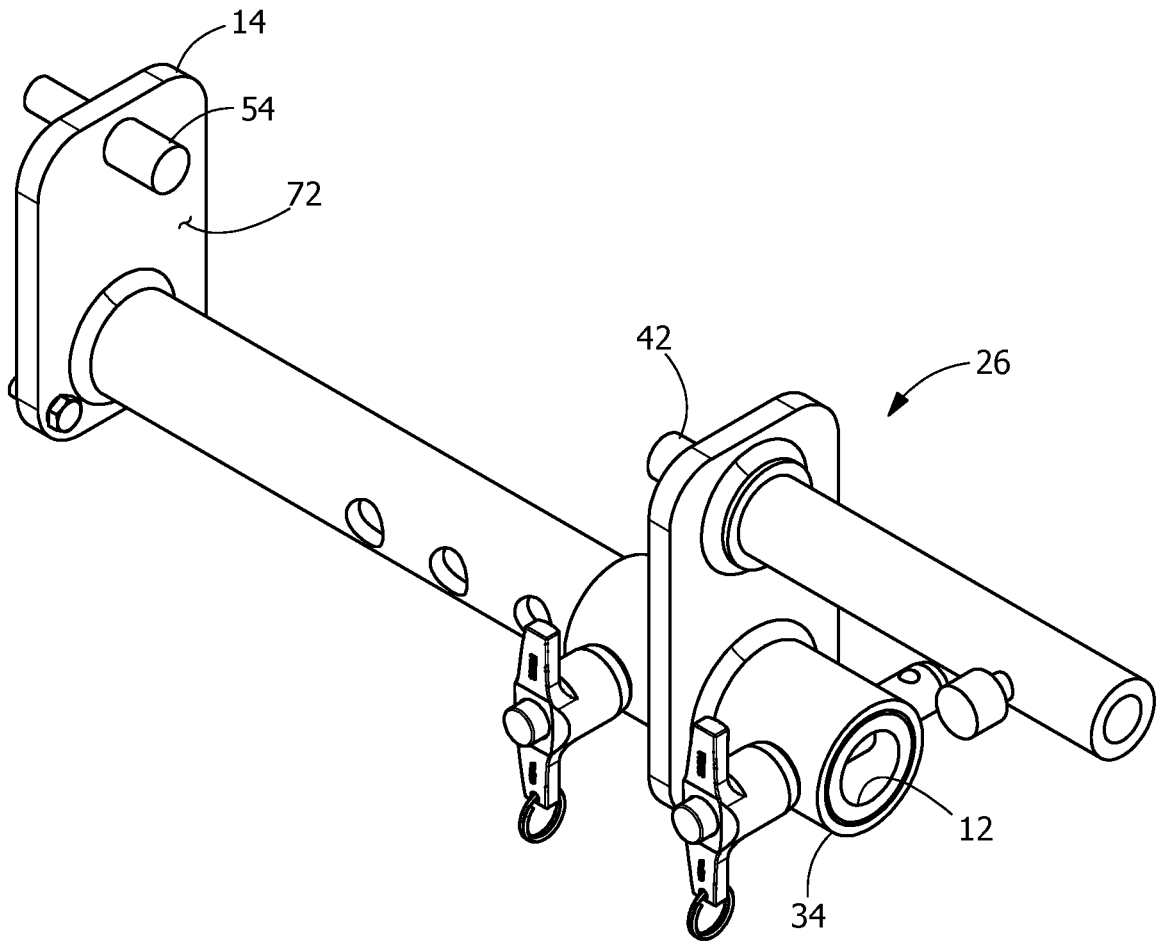
FIG. 2 is a left side top perspective view lying down of the press with the drive device of FIG. 1.
Figure 6:
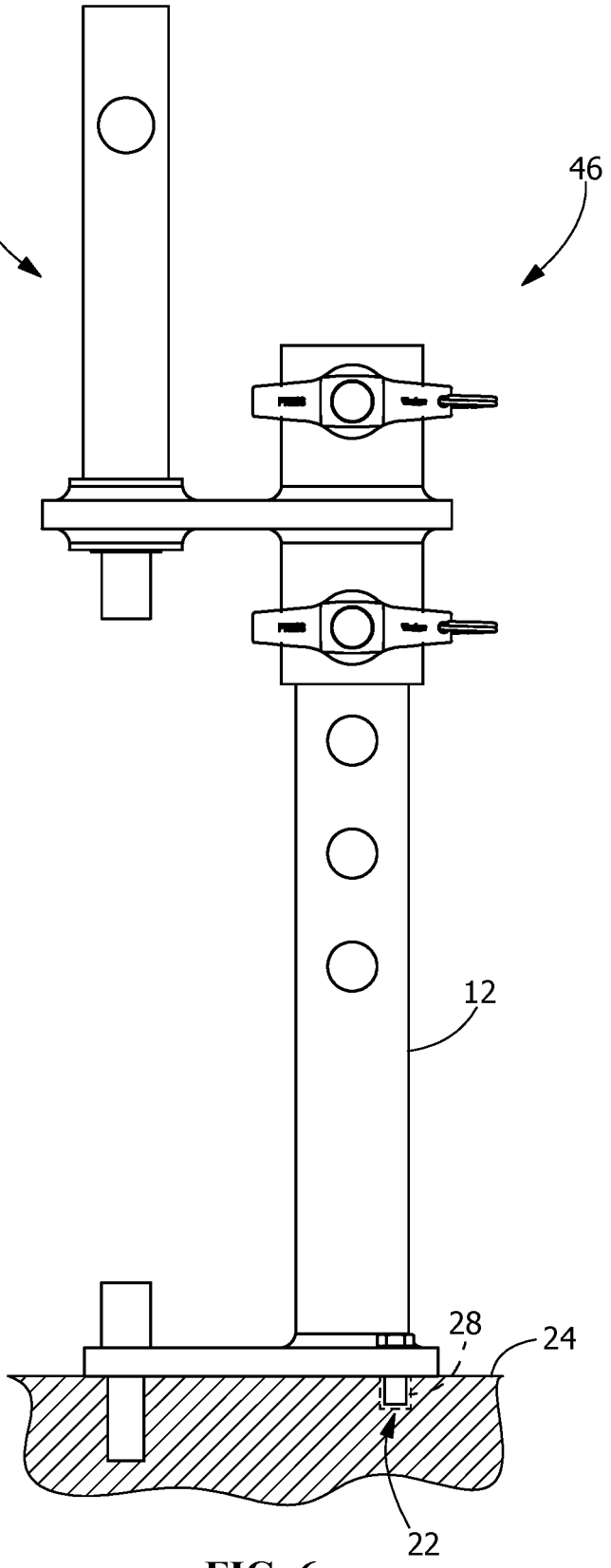
FIG. 6 is a left side elevation view of the press of FIG. 1.
Figure 7:
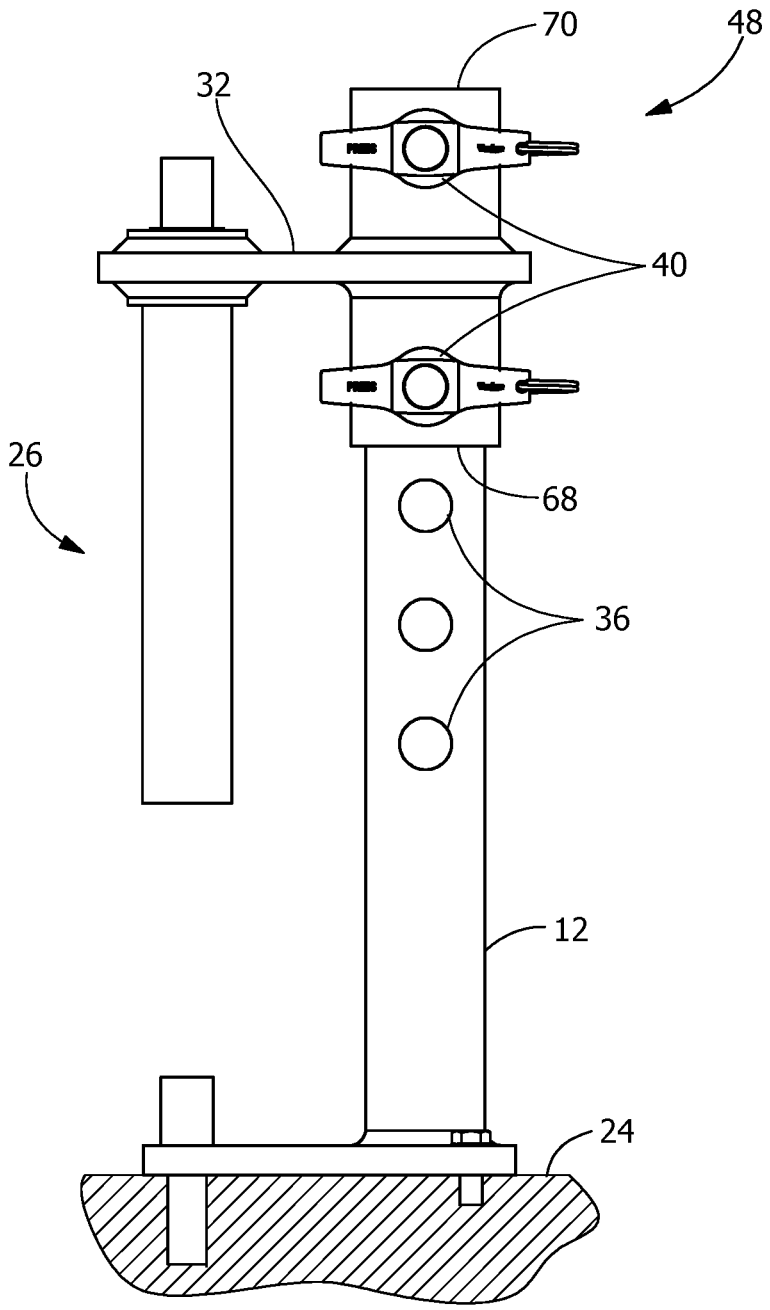
FIG. 7 is a left side elevation view of the press of FIG. 3.
Figure 8:
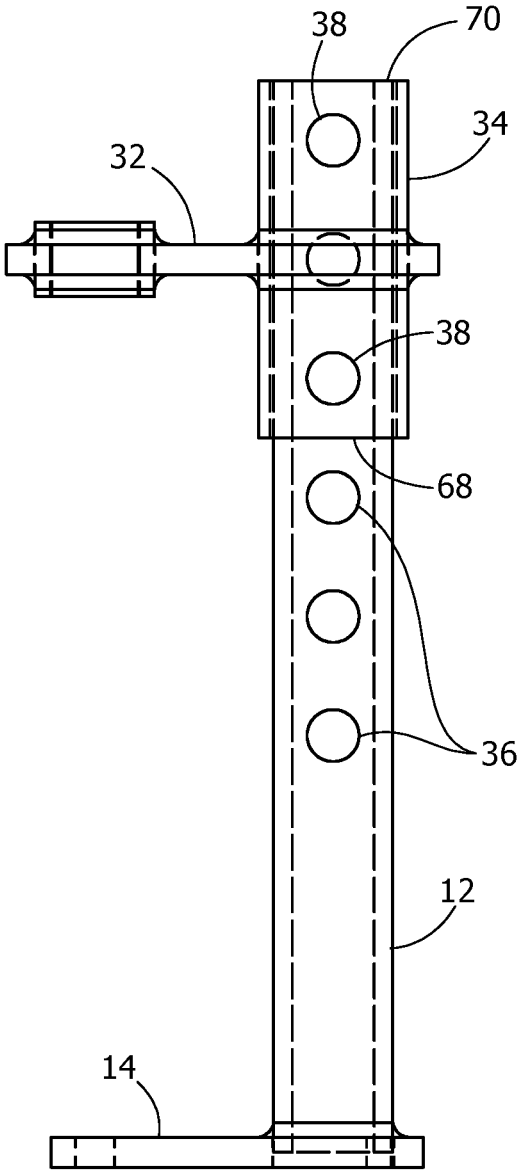
FIG. 8 is a partially assembled left side elevation view of the press of FIG. 6 without a drive device.

As shown in FIGS. 1-8 an exemplary press 10 is now discussed. More specifically, as shown in FIG. 1, press 10 includes an elongate member 12 having a longitudinal axis 13 affixed to a base 14, forming an L-shaped structure 16. As shown, base 14 includes a base portion 18 that supports or reacts the forces generated by a drive device 26 as will be discussed in more detail below. Optionally, base 14 includes a stabilizer 20 for use with a horizontal support surface 24 (FIG. 6) to help maintain or stabilize the press in a standing position on base 14 (the standing position shown in FIG. 6), such as one or more protrusions 22 such as dagger pins, or if support surface 24 includes properly sized and spaced threaded openings 28 (FIG. 6), protrusions 22 may be threaded fasteners, such as depicted in FIG. 6. Alternately or additionally, stabilizer 20 may be or include a flange 30 (FIG. 1) for engaging a corresponding feature formed in the support surface (not shown) for maintaining or stabilizing base 14 during operation of the press. In one embodiment, the support surface may be generally horizontal. In one embodiment, the support surface may be generally vertical. In one embodiment, the support surface may be sloped between vertical and horizontal orientations. In one embodiment, the support surface may be a protrusion or recess for receiving a portion of the base 14 or stabilizer 20.

Returning to FIG. 1, press 10 includes a tab 32 that is affixed to a sleeve 34, such as by welding, and perpendicularly extends outwardly away from sleeve 34 that slidably receives elongate member 12. Elongate member 12 includes a plurality of centered (i.e., passing through the center of elongate member 12) axially aligned apertures 36 formed therethrough and uniformly spaced apart along the length of elongate member 12. Similarly, sleeve 34 includes at least one, and preferably at least two centered (i.e., passing through the center of sleeve 34) axially aligned apertures 38 formed therethrough. Upon elongate member 12 slidably receiving sleeve 34 and bringing corresponding apertures 36, 38 into mutual alignment, a fastener 38 such as a pin, such as a quick release pin such as a ball lock pin, may be inserted through the mutually aligned apertures 36, 38 for nonmovingly securing elongate member 12 and sleeve 34 together. If two through apertures 38 are formed in sleeve 34, the spacing between the two through apertures 38 is a multiple of the uniform spacing between adjacent through apertures 36 formed in elongate member 12, such as a multiple of two, compared to the spacing between the through apertures 36 formed in elongate member 12. As a result, in response to elongate member 12 slidably receiving sleeve 34 within the operating range (i.e., between the minimum and maximum size dimensions) of the press, and further in response to mutually aligning a first corresponding pair of through apertures 36, 38 and inserting fastener 40 through apertures 36, 38, the remaining through aperture 38 is also mutually aligned with a corresponding through aperture 36 for receiving a second fastener 40, such as shown in FIG. 1. Moreover, as further shown in FIG. 1, the pair of fasteners 40 can be removed and reinstalled in four different positions through mutually aligned openings 36, 38, with each different position providing a different or variable distance between tab 32 and base 14 in order to accommodate differently sized objects or workpieces.

As further shown in FIG. 1, once one or more fasteners 40 ((FIG. 1 shows a pair of fasteners 40) are utilized to nonmovably secure elongate member 12 and sleeve 34 together, tab 32 secures a drive device 26 such a pressurized fluid actuator or ram connected via a connector 64 to a pressurized fluid source 66, which drive device 26 having a drivingly movable tip 42 that is movable along an axis 44 that extends through base portion 18 of base 14 and is parallel to longitudinal axis 13. In one embodiment, drive device 26 is an electrical motor. In one embodiment, drive device 26 is a mechanical drive screw. Depending upon the need or application required, drive device 26 of press 10 may be configured in one of two operating arrangements 46, 48 (FIG. 7) relative to base 14, depending upon which of opposed ends 68, 70 faces base 14 of the press. That is, the press can be converted between operating arrangements 46, 48 (FIG. 7) simply by removing the one or more fasteners 40 securing sleeve 34 and elongate member 12 together, slidably disengaging sleeve 34 from elongate member 12, reversing ends 68, 70 of sleeve 34 facing elongate member 12 or base 14, slidably reengaging sleeve 34 and elongate member 12 followed by reinsertion of the one or more fasteners 40 through corresponding mutually aligned apertures 36, 38, simultaneously having the capability to change the distance between base 14 and the sleeve, if needed.

As further shown in FIG. 1, for operating arrangement 46, after fasteners 40 nonmovably secure elongate member 12 and sleeve 34 together, tip 42 of drive device 26 is oriented to face base 14 by orienting end 68 of sleeve 34 to face base 14. During operation of the press, drive device 26 drivingly moves tip 42 in a direction 50 along axis 44 toward base 14 for applying a compression force along axis 44 to corresponding portions of one or more objects 52 or workpieces positioned between and in contact with tip 42 and base portion 18. The compression force will create the pressing, bending, fixturing, and position holding assistance applications. As further shown in FIG. 1, base portion 18 includes a tip 54 that extends away from a surface 72 (FIG. 2) of base 14. In one embodiment, tip 54 includes an opposed tip 56 that extends through a surface 74 of base 14 facing away from drive device 26. In one embodiment, tips 42, 54 have different lengths, and includes a removable retaining feature 58 such as corresponding mating threads with base 14, providing not only additional adjustability for the press, but by removing tips 42, 54, surface 74 of base 14 being generally planar, permitting the press to be stably positioned on a generally horizontal support surface 24 (FIG. 6) even without stabilizer 20 (for example, when the support surface is not compatible with dagger pins or lacks threaded openings, such as a non-porous hard surface that could not be penetrated by pins or fasteners).

It is appreciated by those having ordinary skill in the art that for operating arrangement 46, drive device 26 can, of course, drivingly move tip 42 in a direction opposite direction 50 along axis 44 away from base 14, but such movement merely retracts tip 42 in preparation for another operating press cycle for applying a compressive force as described above.

Figure 3:
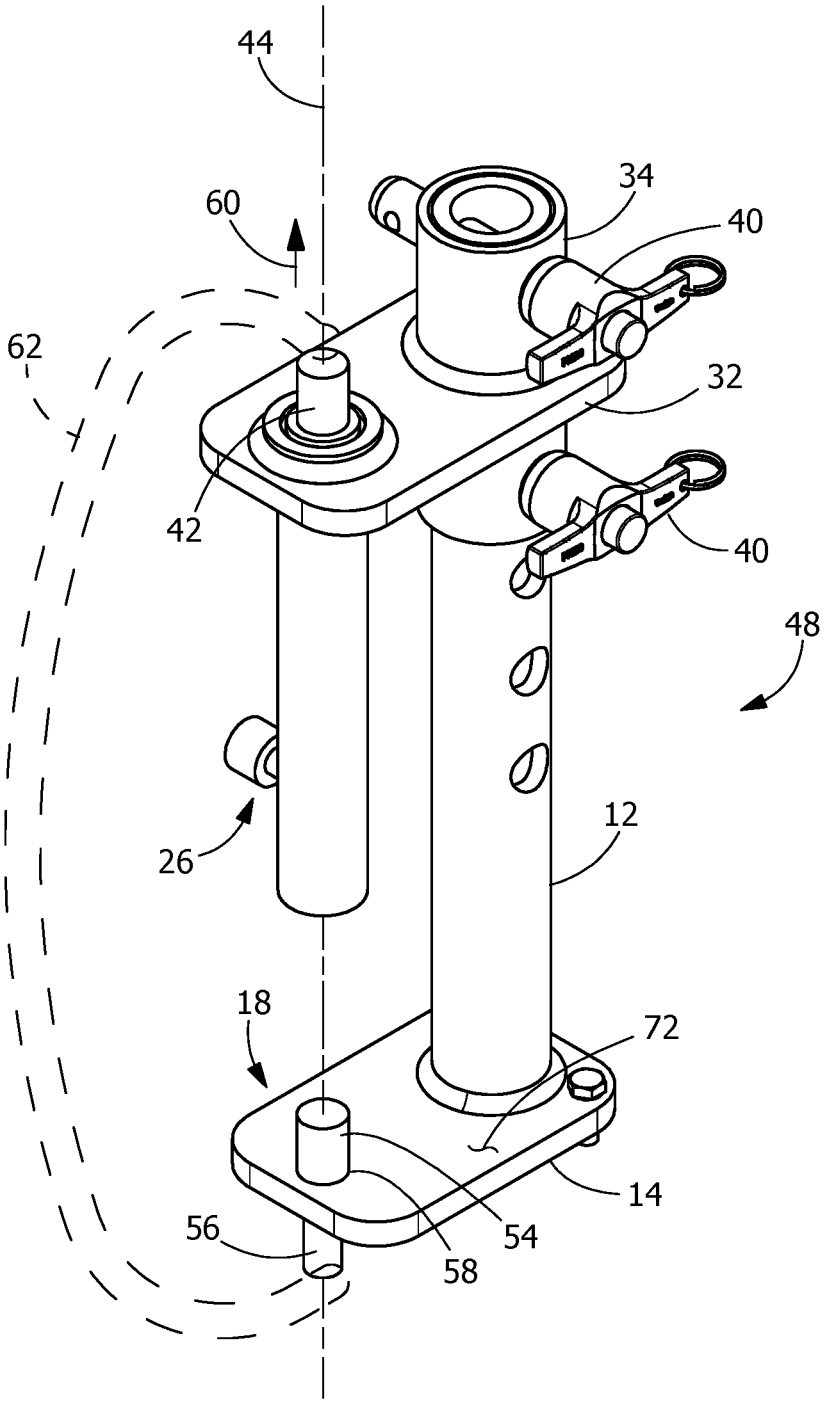
FIG. 3 is a left side view standing on a base of the press with the drive device of FIG. 1. in an exemplary operating arrangement for applying an expansion force to an object or a lifting or separation force of an object away from a horizontal support surface.
Figure 4:
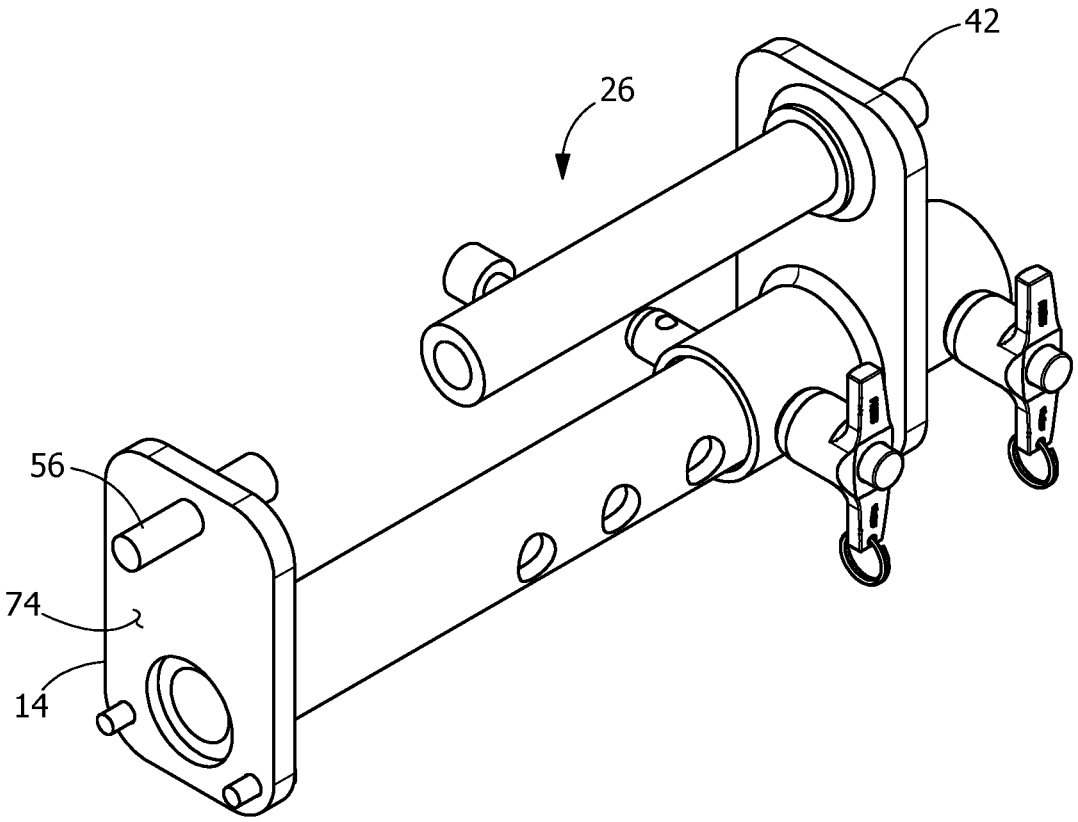
FIG. 4 is a left side bottom perspective view lying down of the press with the drive device of FIG. 1 in an exemplary operating arrangement for applying an expansion force to an object or a lifting force of an object away from a vertical support surface.
Figure 5:
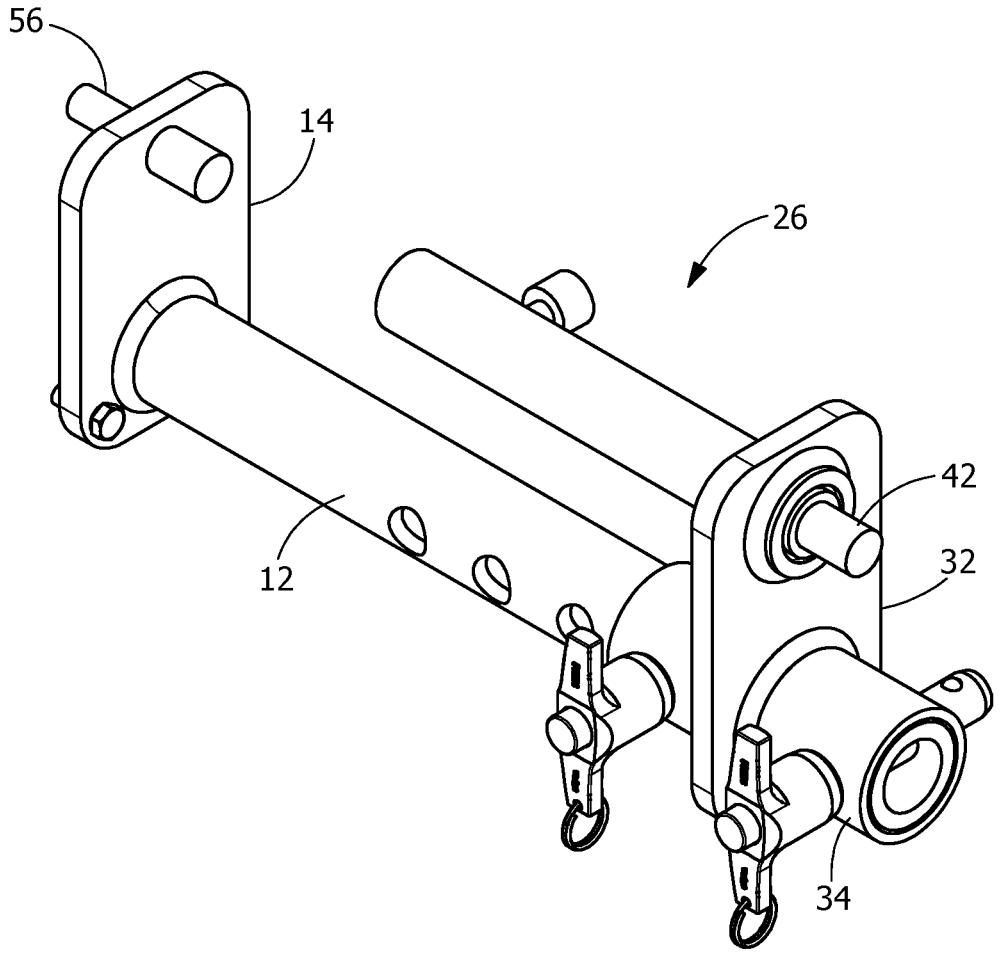
FIG. 5 is a left side top perspective view lying down of the press with the drive device of FIG. 4.

As further shown in FIG. 3, for operating arrangement 48, after fasteners 40 nonmovably secure elongate member 12 and sleeve 34 together, tip 42 of drive device 26 is oriented to face away from base 14 by orienting end 70 of sleeve 34 to face base 14. During operation of the press, drive device 26 drivingly moves tip 42 in a direction 60 along axis 44 away from base 14 for applying an expansion force along axis 44 to corresponding portions of one or more objects 62 or workpieces positioned between and in contact with tip 42 and base portion 18. The expansion force will create the spreading and lifting applications. As further shown in FIG. 3, base portion 18 includes a tip 56 that extends away from surface 74 (FIG. 4) of base 14. In one embodiment, tip 56 includes an opposed tip 54 that extends through surface 72 of base 14 facing drive device 26. In one embodiment, tips 52, 54 have different lengths, and includes a removable retaining feature 58 such as corresponding mating threads with base 14, providing additional adjustability for the press.

It is appreciated by those having ordinary skill in the art that for operating arrangement 48, drive device 26 can, of course, drivingly move tip 42 in a direction opposite direction 60 along axis 44 toward base 14, but such movement merely retracts tip 42 in preparation for another operating press cycle for applying an expansion force as described above.

In one embodiment, the press components are manufactured from steel or other suitable material and machining processes. In one embodiment, the press is 30 inches or less in height, 10 inches or less wide, and 10 inches or less in length. In other embodiments, the press may be different from 30 inches in height, different from 10 inches wide, and different from 10 inches long. That is, the press may be sized for an application. In one embodiment, commonly manufactured fasteners 40 such as pins and drive devices such as pressurized fluid actuators also referred to as hydraulic cylinders are used with the press.

In one embodiment the press weighs between 20 pounds and 120 pounds, between 20 pounds and 100 pounds, between 20 pounds and 70 pounds, between 20 pounds and 50 pounds, between 25 pounds and 35 pounds, and about 30 pounds, about 40 pounds, about 50 pounds, or any combination in between.

In one embodiment, the lifting capacity of the press is 4 tons. In one embodiment, the lifting capacity of the press is less than 4 tons. In one embodiment, the lifting capacity of the press is greater than 4 tons.

In one embodiment, the range of drivable movement of the tip by the driving device is sufficient for an application, such as 6 inches. In one embodiment, the range of drivable movement of the tip by the driving device is less than 6 inches. In one embodiment, the range of drivable movement of the tip by the driving device is greater than 6 inches.

For purposes herein, the term "portable" is intended to be mean that a person of average strength and dexterity can, without assistance of another and without tools, assemble, disassemble, convert between operating arrangements, and lift and transport for short distances (e.g., at least 5 feet) without the aid of a lifting assistance device, the object or tool in question.

That is, in one embodiment, the press of the present invention is portable.

The various uses identified in the present application combined with the portability of the device are the unique characteristics that differentiate the singular press of the present invention from other combinations of tools.

Hydraulic Shop Pressing Application:

The pressing application is used when pressing the bearings, shafts, connecting drivetrain joints, or any mechanical insert that would need replaced and is fastened together by pressing together due to tight tolerances. These tight tolerances combined with industrial wear and tear create a binding of materials in pressed applications. This requires a high magnitude directed force to separate such a bearing from its inserted piece. Pressing is also required to insert the new bearing type application as a replacement part.

Sheet Metal Bending Application:

Bending can be performed by using common industry inserts or fabricated attachments when added to create angles and shaping of the work piece. Bending occurs as a result of the directed compression or expansion force from the drive device moving towards or away from the object or workpiece using a tip having an angular shape or an angularly shaped attachment (or other shape) associated with the base portion of the press. The compression force will mold the object or workpiece composed of metal or other materials in the shape of the tip or tip attachment. Common industry attachments can also be added to the drive device and the base portion of the press. This will create a stamping operation on the material placed between the drive device tip and the base portion of the press.

Combination Bench Vice:

The press of the present invention can be mounted to a work bench such as by the stabilizer 20 and used to tightly position objects or workpieces of various sizes. As a result, the press can replace commonly found bench vices that use a ball screw application with a pressurized fluid force gripping the workpiece.

Adjustable Fixtures:

The press can be used to position materials in place for fastening or other requirement, such as in preparation for welding of metals, positioning for marking, fitting of components together, or fastening together components. Positioning can be done on a workbench or directly on the workpiece. Comparable fixturing devices utilize a ball screw tightening mechanism to apply pressure. In contrast, the press of the present invention can use pressurized fluid to generate forces for securing the workpiece tightly in place.

Lifting Applications:

The press of the present invention can be used for lifting applications. Lifting is achieved by placing the base on a firm support surface to hold the lifted weight (example—the floor of a factory) and the tip or tip attachment of the drive device 26 can be adjusted to accommodate the range of dimensions, and resulting in the lift. The drive device attachment is reversible to create an expansion driving force away from the support surface supporting the base. The drive device 26 would be positioned under the object to be lifted and the drive device 26 activated to generate the lifting force. The base 14 would be sufficiently sized to provide for a safe lifting environment, possibly in combination with a stabilizer 20 (FIG. 1) engaging a support surface. The expansion force generates a lifting force greater than the weight of the object (or corresponding portion of the weight of the object, such as the portion of an automobile associated with one tire of the automobile such as when the object is to replace one of the tires). When the tip of drive device 26 positioned beneath the object is vertically extended into contact with the object, and the tip is then further vertically extended, the pressurized fluid of the drive device 26 applies a lifting force to the object being lifted. The weight of the object is reacted by the press structural components to the base 14 of the press supported by the support surface.

Spreading Application:

The press of the present invention can be used for spreading purposes by reversing ends 68, 70 of the sleeve 34 facing the base 14 of the press or facing the elongate member 12 of the base 14 of the press from the position or orientation of the press being previously used to generate a compressive force, as previously discussed. Reversing the ends of the sleeve 34 similarly results in reversing the orientation of the drive device 26, and therefore similarly results in reversing the direction of the drivingly moved tip 42 of the drive device 26 relative to the base 14 (i.e., from a drive device tip movement direction 50 toward the base 14 (a compressive force) to a drive device tip movement direction 60 away from the base (an extension force)). The use of this application would be to spread or result in a wider space on a desired workpiece with the intent of spreading or increasing the dimension between the base point and a desired spread point to a position that is yet further apart. The press can be adjusted to fit the required dimensions by adjusting the position of the drive device tip or tip attachment. This is performed by placing the base portion of the press against one position or portion of the workpiece (base position) and the drive device tip or tip attachment against another desired point or portion (spreading position point) of the workpiece. As the drive device tip is drivingly moved or extended outwardly towards the spreading position point, an extension pressure will begin to be applied to the base position and the spreading position point. This will spread or increase the distance between the two positions, thereby performing a spreading function.

In the present disclosure, other than where otherwise indicated, all numbers expressing quantities or characteristics are to be understood as being prefaced and modified in all instances by the term "about." Accordingly, unless indicated to the contrary, any numerical parameters set forth in the following description may vary depending on the desired properties one seeks to obtain in the embodiments according to the present disclosure. At the very least, and not as an attempt to limit the application of the doctrine of equivalents to the scope of the claims, each numerical parameter described in the present description should at least be construed in light of the number of reported significant digits and by applying ordinary rounding techniques.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicant reserves the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. .sctn.112, first paragraph, and 35 U.S.C. .sctn.132(a).

The grammatical articles "one," "a," "an," and "the," as used herein, are intended to include "at least one" or "one or more," unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

Any patent, publication, or other disclosure material, in whole or in part, that is said to be incorporated by reference herein, is incorporated herein in its entirety, but only to the extent that the incorporated material does not conflict with existing definitions, statements, or other disclosure material expressly set forth in this disclosure. As such, and to the extent necessary, the express disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A portable press consisting of:

a base affixed to an end of a single first elongate member having a longitudinal axis, the base having a base portion;

a sleeve slidably received by the single first elongate member, the sleeve securable to the single first elongate member by at least two fasteners;

a tab affixed to and extending away from the sleeve, the tab securing a drive device having a tip drivingly movable away from the drive device along a second axis parallel to the longitudinal axis, the second axis extending through the base portion;

wherein at least one fastener of the at least two fasteners is positioned on one side of the tab and at least one other fastener of the at least two fasteners is positioned on an opposite side of the tab;

wherein in response to the at least two fasteners securing the drive device in a first operating arrangement relative to the base, the drive device drivingly moves the tip toward the base for applying a compression force along the second axis to corresponding portions of one or more objects positioned between and in contact with the tip and the base portion;

wherein in response to the at least two fasteners securing the drive device in a second operating arrangement opposite the first arrangement relative to the base, the drive device drivingly moves the tip away from the base for applying an expansion force along the second axis to corresponding portions of one or more objects positioned between and in contact with the tip and the base portion.

2. The portable press of claim 1, wherein the at least two fasteners are quick release pins.

3. The portable press of claim 2, wherein the quick release pins are ball lock pins.

4. The portable press of claim 1, wherein each of the single first elongate member and the sleeve includes a plurality of corresponding through apertures for receiving the at least two fasteners.

5. The portable press of claim 4, wherein the plurality of corresponding through apertures permit the at least two fasteners to secure the base and the tab at a variable distance therebetween.

6. The portable press of claim 1, wherein the base portion comprises a second tip extending away from the base in a direction parallel to the second axis.

7. The portable press of claim 6, wherein the second tip extends to a third tip, the second tip extending through and away from a first surface of the base along the second axis, the third tip extending through and away from a second surface opposite the first surface.

8. The portable press of claim 1, wherein the press weighs between 20 pounds and 120 pounds.

9. The portable press of claim 1, wherein the base includes a stabilizer.

10. The portable press of claim 9, wherein the stabilizer includes at least one fastener extendable through the base and into a support surface.

* * * * *